United States Patent [19]

Kobayashi

[11] 4,336,480

[45] Jun. 22, 1982

[54] CATHODE RAY TUBE

[75] Inventor: Hiroo Kobayashi, Nagaokakyo, Japan

[73] Assignee: Mitsubishi Denki Kabushiki Kaisha, Tokyo, Japan

[21] Appl. No.: 132,161

[22] Filed: Mar. 20, 1980

[30] Foreign Application Priority Data

| | | | |
|---|---|---|---|
| Mar. 24, 1979 | [JP] | Japan | 54-35919 |
| May 29, 1979 | [JP] | Japan | 54-68612 |
| Aug. 23, 1979 | [JP] | Japan | 54-107853 |
| Nov. 12, 1979 | [JP] | Japan | 54-148261 |
| Jan. 11, 1980 | [JP] | Japan | 55-2365 |

[51] Int. Cl.[3] ..... H01J 29/92

[52] U.S. Cl. ..... 313/495; 313/112; 313/477 HC

[58] Field of Search ..... 313/112, 474, 477 HC, 313/478, 483, 495

[56] References Cited

U.S. PATENT DOCUMENTS

| | | | |
|---|---|---|---|
| 3,299,305 | 1/1967 | Kreuder | 313/495 |
| 3,382,393 | 5/1968 | Schwartz | 313/112 X |

*Primary Examiner*—Eugene La Roche

*Attorney, Agent, or Firm*—Wenderoth, Lind & Ponack

[57] ABSTRACT

The disclosed cathode ray tube for a display system includes a convex face plate having a radius of curvature less than its outside maximum dimension and a phosphor screen disposed on the inner surface of the face plate and entirely irradiated with an unfocussed beam of electrons from an electron gun to luminesce in a monochromatic color. The face plate may be formed of glass having a color identical to or approximating the luminescent color of the phosphor screen. Also a phosphor for the screen may be colored to have a color identical to or approximating its luminescent color.

9 Claims, 6 Drawing Figures

CATHODE RAY TUBE

BACKGROUND OF THE INVENTION

This invention relates to display equipment, and more particularly to a cathode ray tube used with a display system suitable for a giant color display.

In the conventional construction of giant display systems, for example, electric light display boards used with baseball fields, apparatus for displaying advertising pictures or the like on the roof top or wall surface of buildings, etc., pictures have been formed by selectively effecting the turning-on and -off of a multitude of colored electric lamps arranged in a predetermined pattern. Such display systems have had many difficult problems to be solved. For example, when electric lamps are used, light is produced by heating their filaments to red heat and therefore the light produced assumes principally a red or a white-orange color. Accordingly, in order to pick up green or blue light from those electric lamps, glass plates colored with green or blue have been used. However it has fairly been difficult to produce a large amount of the green or blue light. Also, in display systems using the electric lamps as described above, the brightness modulation of each picture element has been required to rely on means of turning a current applied to the filament of the mating electric lamp on and off, or for making the applied current variable. Further such means has had many problems, such as that its frequency response is as low as 10 Hertz or less and, in addition, the applied current is not linear with respect to the quantity of emission of light and may change the color of light emitted by the associated electric lamp. Furthermore, intermediate color tones have been difficult to produce. Moreover, since electric lamps on the order of 10 watts or more have been generally employed, a giant display which may include several ten thousand of such electric lamps arranged in a predetermined pattern has encountered problems such as large power consumption, and the total quantity of heat generated by the electric lamps becomes great and so on.

In order to solve the problems as described above, the present inventor has devised cathode ray tubes as light sources for display systems such as described above.

For example, a display system can be formed of a multitude of triads of red, green and blue cathode ray tubes arranged in rows and columns to display thereon picture images as desired. Where that electric lamps generally have an efficiency of 10 lumens per watt for converting electrical to optical energy, cathode ray tubes have an efficiency of about 100 lumens per watt. Therefore, display systems using cathode ray tubes have a better efficiency of converting electrical to optical energy by about one order of magnitude as compared with those employing electric lamps. Also since cathode ray tubes include phosphor screens luminescing in their respective colors including red, green and blue, a light source can be not only produced so as to luminesce in any desired color but also there can readily be provided light sources having a fairly good frequency response. This results in the display of animations without any hindrance. Further such light sources are optimum for displaying intermediate color tones because electrical signals applied to the light sources can faithfully change the resulting brightnesses thereof. In addition, the use of the cathode ray tubes results in an extremely low power consumption and hence an advantageous useful lifetime as compared with the use of the electric lamps wherein filament currents are variable.

From the foregoing it will readily be understood that, the use of light sources formed of cathode ray tubes provide excellent performance, reliability, cost of maintenance, power consumption etc. particularly for giant display systems.

While the use of a cathode ray tube as the light source of display systems has various advantages as described above it is seen that those advantages can be enhanced provided that the cathode ray tube can produce an optical output at its maximum without the effective diameter thereof being increased.

It is required that the cathode ray tube used with display systems of the type referred to have a satisfactory contrast even when irradiated with sun in the daytime because of the purpose and place of installation thereof.

Accordingly it is an object of the present invention to provide a new and improved cathode ray tube used with a display system to produce an optical output at its maximum and having a high contrast.

SUMMARY OF THE INVENTION

The present invention provides a cathode ray tube for a display equipment comprising an evacuated envelope, including a pair of opposite ends, a face plate disposed at one of the opposite ends of the evacuated envelope, a monochromatic phosphor screen disposed on the inner surface of the face plate to luminesce in a color selected from a plurality of colors including red, green and blue, and an electron gun disposed within the evacuated envelope opposed to the phosphor screen and held by the other end of the evacuated envelope, the electron gun generating a non-convergent or an unfocussed beam of electrons, said phosphor screen being flooded with the non-convergent beam of electrons over electron gun to luminesce simultaneously from the substantially the entire area of the phosphor screen.

Preferably, the face plate may be in the form of a curved surface having a radius of curvature less than the outside maximum dimension thereof.

Advantageously the face plate may be formed of a colored glass material having a color identical to or approximating that in which the phosphor screen luminesces.

The face plate and the evacuated envelope may be formed as a unitary structure of a colored glass material having a color identical to or approximating that in which the phosphor screen luminesces.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
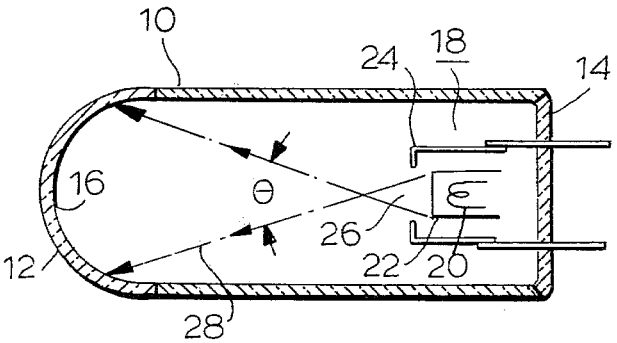
FIG. 1 is a side elevational sectional view of one embodiment according to the cathode ray tube of the present invention.

Referring now to FIG. 1 of the drawings, there is illustrated one embodiment according to the cathode ray tube of the present invention. The arrangement illustrated comprises an evacuated envelope 10 in the form of a hollow cylinder having one end closed by a face plate 12 and the other end terminating at a flat stem or base 14. The face plate 12 is formed of any suitable glass material as will be described later and includes a relatively short hollow cylindrical portion identical in both outside and inside diameters to the envelope 10 and merged into to a curved surface member convex toward the exterior of the envelope 10 and symmetric with respect to the longitudinal axis of the evacuated envelope 10. As shown in FIG. 1, the cylindrical portion of the face plate 12 is hermetically connected to the one end of the envelope 10 by fusion welding. According to the present invention the curved surface member of the face plate 12 should have a radius of curvature less than the outside maximum dimension or diameter thereof. The inner surface of the curved face surface member is coated with a monochromatic phosphor screen 16.

An electron gun generally designated by the reference numeral 18 is disposed within the envelope 10 adjacent to the other end thereof or the flat base 14 and held by the latter by has terminals extending through and sealed in the base 14.

The electron gun 18 includes a heater 20, a cathode electrode 22 and a grid electrode 24 provided with a central hole 26. The components of the electron gun 18 as described above are connected to the abovementioned terminals as shown, for example, by the grid electrode 24 connected to two of those terminals. All the terminals serve to apply to the components of the electron gun 18 voltages as required. When supplied with such voltages, the electron gun 18 is arranged to project a non-convergent or an unfocussed beam of electrons 28 upon substantially the entire area of the phosphor screen 16 to flood it with the beam of electrons 28 as shown by the broken line labelled 28 in FIG. 1. The beam of electrons 28 is called hereinafter a flooding beam of electrons.

The operation of the arrangement shown in FIG. 1 will now be described. First, the grid electrode 24 is supplied with a voltage negative with respect to the cathode electrode 22 while a predetermined current flows through the heater 20 to heat the latter. Then by causing the voltage at the grid electrode 24 to approximate a voltage at the cathode electrode 22, the latter electrode projects the beam of electron 28 toward the phosphor screen 16. The beam of electrons 28 forms an unfocussed beam of electrons having a diffusing angle $\theta$ as determined by various conditions such as the diameter of the central hole 26 in the grid electrode 24, the space formed between the grid and cathode electrodes 24 and 22 respectively, the anode voltage etc. Then substantially the entire area of the phosphor screen 14 is irradiated with that unfocussed beam of electrons 28 so as to luminesce in a color corresponding to the phosphor forming the phosphor screen 16.

The present invention contemplates to maximize the optical output from the cathode ray tube without increasing the outside diameter thereof. In other words, when the phosphor screen 16 is irradiated with the beam of electrons 28 which cover the effective diameter of the phosphor screen 16, it is contemplated to maximize the surface area of the phosphor screen 16 without increasing the effective diameter thereof. Assuming that the beam of electrons 28 irradiates the phosphor screen 16 with a uniform density of irradiation, it is possible that the larger the surface area of the phosphor screen 16 the higher the optical output from an associated cathode ray tube will be.

From the foregoing it is seen that, unlike direct view type cathode ray tubes generally used in the field of television, the cathode ray tube of the present invention includes a face plate 12 which is not required to be formed into a flat surface or a curved surface approximating a flat surface. In order to produce the optical output at the maximum, it is required only to make the surface area of the phosphor screen 14 as large as possible and to irradiate it with the beam of electrons 28 having a density as high as possible. For these reasons, the curved surface member of the face plate 12 coated with the phosphor screen 16 has been formed as a spherical or a paraboloidal surface having a radius of curvature less than the outside maximum dimension.

In summary, the present invention provides a cathode ray tube for producing an optical output at its maximum without increasing the effective diameter thereof which is suitable for use as the light source of giant display systems.

Figure 2:
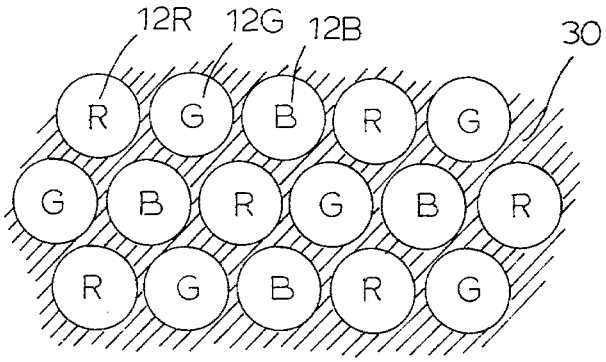
FIG. 2 is a fragmental plan view of an array of the face plates shown in FIG. 1 of a plurality of the cathode ray tubes according to the present invention arranged to form a display surface.

A multitude of cathode ray tubes such as shown in FIG. 1 can be arranged in a predetermined pattern to form a display system. FIG. 2 shows a plan view of an array of cathode ray tubes with circular face plates arranged to form a display system. In FIG. 2, the reference numerals 12 suffixed with the reference characters R, G and B designate face plates on which red R, green G and blue B are developed respectively. In FIG. 2 a first row is shown as being formed of the red, green and blue face plates 12R, 12G and 12B respectively in the form of circles repeatedly arranged in aligned relationship in the named order with narrow spaces formed between each pair of adjacent face plates. A second row is formed of similar face plates arranged in the same manner as those in the first row excepting that in the second row each face plate is located between and below a pair of adjacent face plates in the first row and which are different in color from the respective face plates in the second row and from each other and with narrow spaces formed therebetween. A third row has face plates located just below those of the first row and identical in color thereto. Each triad of red, green and blue face plates 12R, 12G and 12B respectively are located to be adjacent to one another to form one light source of the display system. In FIG. 2, it is seen that the clearances between the adjacent face plates inevitably form a dead space 30 denoted by the hatched portion.

Figure 3:
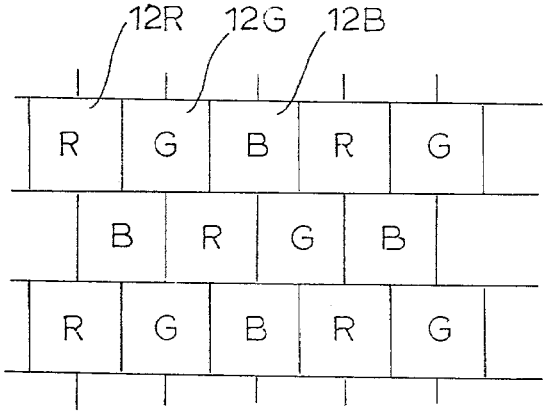
FIG. 3 is a view similar to FIG. 2 but illustrating a modification of the array of the face plates shown in FIG. 2.

In order to eliminate or minimize the dead space 30, the cathode ray tube of the present invention preferably has the face plate formed into a square. In this case a multitude of such cathode ray tube are arranged in the manner as shown in FIG. 3 wherein like reference numerals and characters designate the components identical or corresponding to those shown in FIG. 2.

Figure 4:
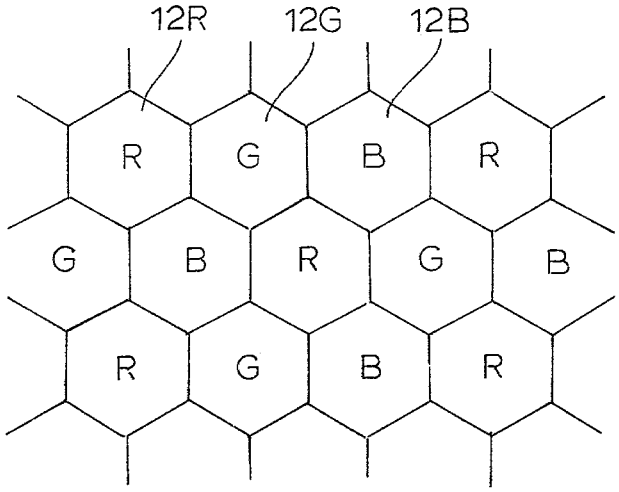
FIG. 4 is a view similar to FIG. 2 but illustrating another modification of the array of the face plates shown in FIG. 2.

Alternatively the face plate may be in the form of a regular hexagon. Then a multitude of the face plates in the form of regular hexagons can be arranged in the manner as shown in FIG. 4 wherein like reference numerals and characters also designate the components identical or corresponding to those shown in FIG. 2. It is seen that each of the arrangements shown in FIGS. 3 and 4 has the face plates arranged in the same manner as shown in FIG. 2 but has substantially no dead space, resulting in an efficient display systems.

It will readily be understood that the use of face plates in the form of regular triangles will produce a similar result.

Apart from cathode ray tubes supplied with an anode voltage as low as about 1,500 volts, for example, single acceleration type cathode ray tubes for oscilloscope use, the supply of the anode voltage to a cathode ray tube is generally accomplished through a metallic cap buried in the outer peripheral portion of an associated evacuated envelope. When a multitude of such cathode ray tubes are juxtaposed to form a display system, anode terminals disposed on the walls of the envelopes have caused problems such as that interspaces between the adjacent cathode ray tubes must be increased for the connection of the anode terminals to respective leads, the disposal of such leads in the interspaces must be provided for, safety must be assured, and so on.

Figure 5:
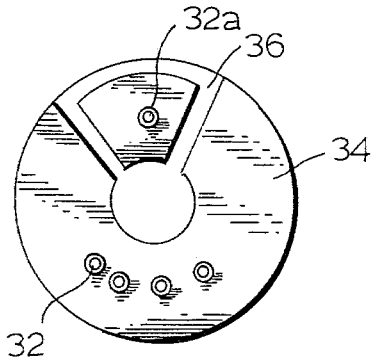
FIG. 5 is a schematic plan view of a modification of the base portion of the arrangement shown in FIG. 1.

In order to avoid those problems, the cathode ray tube of the present invention can include a stem or base portion having a structure as shown in FIG. 5. In the arrangement illustrated, an anode pin 32*a* is provided on an electrically insulating pin plate in the form of a sector having a minor arc and the remaining pins 32 are on another electrically insulating pin plate 34 in the form of a sector having a major arc and disposed opposite to the firstmentioned sector to increase the spacing between the anode pin 32*a* and the pins 32. Further a barrier 36 is disposed around the anode pin 32*a* to increasing a creeping distance. Those pin plates are disposed on the outside of the base portion.

Therefore an anode voltage on the order of more than 5 kilovolts can be applied to the anode electrode (not shown) through the base portion as shown in FIG. 5 without any hindrance. In addition, the arrangement of FIG. 5 is very advantageous in that the cathode ray tube can be manufactured inexpensively because the evacuated envelope is not separately provided with the anode terminals.

In the cathode ray tube of the present invention as described above, the beam of electrons irradiating the phosphor screen has a high density as compared with conventional cathode ray tubes. Therefore, in order to prevent the glass material of the face plate 12 from browning due to the beam of electrons and accordingly prevent the brightness of the cathode ray tube from being reduced during long service, it is required to make the content of lead in the glass materials as low as possible. It has been experimentally found that glass materials having a content of lead of not higher than 3% by weight can be put to practical use. It is to be understood that the use of glass including no lead is better.

Almost all of phosphors used with general cathode ray tubes possess whitish body colors and have the reflectivity of light substantially approximating unity. Also it is usual to form the face plate of cathode ray tubes of transparent glass having a high optical transmissivity. Under these circumstances, sunrays incident upon the face plate of cathode ray tubes irradiate the phosphor screen applied to the inner surface of the face plate. This might cause the phosphor screen to luminesce in a whitish color thereby to lose contrast.

In order to eliminate this objection, the present invention can use a pigmented phosphor including particles coated with a pigment having a color identical to or approximating that of the luminescent color of the phosphor whereby the phosphor per se has a body color identical to or approximating its luminescent color. Alternatively, the glass material forming the face plate may be colored to correspond with the luminescent color of the mating phosphor. These measures permit a clean color and a high contrast in the daytime.

More specifically, by using the pigmented phosphor with an enhanced body color by using particles coated with a color identical to or approximating the luminescent color, the resulting phosphor screen can have the reflectivity thereof with respect to external light reduced by from about 30 to about 40% without sacrifying the intensity of the luminescent color thereof.

Alternatively the face plates of the red, green and blue cathode ray tubes may be formed of red, green and blue glass materials prepared as follows: For the red cathode ray tube, gold, for example, may be mixed with a glass material during its melting to prepare a glass material colored with red. Then the face plate is formed of the red glass material thus prepared and the inner surface thereof is coated with a phosphor luminescing in red. For a green tube chromium oxide, for example, may be mixed with a melted glass material to prepare a green glass material of which the face plate is formed. Then the inner surface of the face plate thus formed is coated with a phosphor luminescing in green. Similarly, the face plate of the blue tube may be formed from a blue glass having cobalt or the like mixed therewith in its melted state and the inner surface thereof is coated with a phosphor luminescing in blue. By combining the colored face plate and the phosphor as described above, a cathode ray tube serving as a light source can be provided which has a high contrast in the daytime because a light portion outside of the required wavelength range is absorbed by the glass material forming the face plate.

Further it will readily be understood that it is possible to make the contrast higher by combining a colored face plate with a pigmented phosphor luminescing in a color identical to or approximating that of the face plate, in accordance with the extent to which the face plate is colored.

Also a pigmented phosphor may be combined with a face plate formed of a glass material other than a glass material colored with any one of three primary colors or red, green and blue colors, for example, grey glass. More specifically, the face plate may be formed of colored glass such as grey glass having a neutral wavelength characteristic in the visible range to alleviate the influence of external light. The term "neutral wavelength characteristic in the visible range" means the characteristic that the transmissivity is not changed by a wavelength within the visible range.

Figure 6:
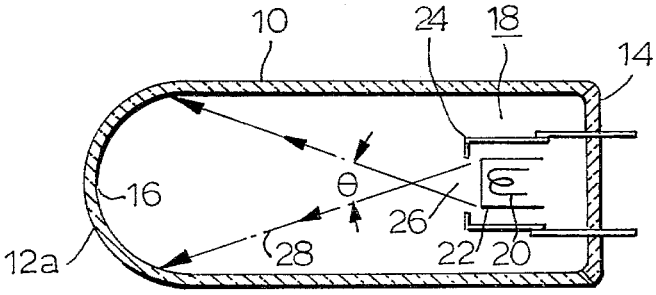
FIG. 6 is a view similar to FIG. 1 but illustrating a modification of the present invention.

FIG. 6 shows a modification of the present invention wherein the evacuated envelope 10 and the face plate 12 are formed into a unitary structure of a colored glass material such as described above. In other respects, the arrangement illustrated is identical to that shown in FIG. 1. In FIG. 6, therefore, like reference numerals designate the components identical or corresponding to those shown in FIG. 1.

The arrangement of FIG. 6 is advantageous in that the operation of sealing the face plate to the envelope can be eliminated and a water proof structure can readily be made.

From the foregoing it is seen that the present invention provides a cathode ray tube serving as a light source which tube produces an optical output at its maximum without increasing the outside maximum dimension thereof while it luminesces with good color and has a high contrast even in the daytime.

While the present invention has been illustrated and described in conjunction with a few preferred embodiments thereof it is to be understood that numerous changes and modifications may be resorted to without departing from the spirit and scope of the present invention.

What is claimed is:

1. A cathode ray tube for a display system, comprising: an evacuated envelope including a pair of opposite ends, a face plate disposed at one of the opposite ends of said evacuated envelope, a monochromatic phosphor screen disposed on the inner surface of said face plate to luminesce in a color taken from among the colors red, green and blue, and an electron gun disposed within said evacuated envelope positioned at the other end of said evacuated envelope, said electron gun generating an unfocussed beam of electrons directed toward said phosphor screen and said unfocussed beam flooding said phosphor screen with electrons from said electron gun for causing said screen to luminesce simultaneously over substantially the entire area of said phosphor screen, and a base portion disposed at the other end of said evacuated envelope, and means extending through said base portion to said electron gun capable of carrying anode voltage supplied to said cathode ray tube of not less than 5 kilovolts.

2. A cathode ray tubes as claimed in claim 1 wherein said face plate has a convexly curved outer surface having a radius of curvature less than the outside maximum dimension thereof.

3. A cathode ray tube as claimed in claom 1, wherein the envelope of said cathode ray tube has a base portion having an anode terminal thereon, said base portion being at the end of the envelope opposite to the face plate, and a sector-shaped insulating layer on said base portion around said anode terminal having an arc of less than 180° and further having at least a further terminal thereon and a further sector-shaped insulating layer on said base portion around said further terminal having an arc of more than 180° and having the peripheral ends thereof spaced from the peripheral ends of said first-mentioned section-shaped insulating layer.

4. A cathode ray tube as claimed in claim 1 wherein said face plate is formed of a glass material having lead therein in an amount of no more than 3% by weight.

5. A cathode ray tube as claimed in claim 1 wherein said face plate is formed of a colored glass material having a color identical to or approximating the luminescent color of said phosphor screen thereon.

6. A cathode ray tube as claimed in claim 1 wherein said face plate is formed of a glass material having a neutral transmissivity to light in the visible range.

7. A cathode ray tube as claimed in claim 6 wherein said plate is formed of a gray glass material.

8. A cathode ray tube as claimed in claim 1 wherein said phosphor screen is formed of a pigmented phosphor having therein particles coated with a pigment having a color identical to or approximately the luminescent color of said phosphor screen for enhancing the color of said screen.

9. A cathode ray tube as calimed in claim 1 wherein said face plate and said evacuated envelope are a unitary structure of a colored glass material having a color identical to or approximating the luminescent color of said phosphor screen.

* * * * *